United States Patent [19]

Ito

[11] Patent Number: 4,594,784

[45] Date of Patent: Jun. 17, 1986

[54] APPARATUS FOR DRAWING AN ELLIPSE USING A PIECE OF STRING

[76] Inventor: Mikio Ito, NO. 204-362, Jō, Sakura-shi, Chiba-ken, 285, Japan

[21] Appl. No.: 622,555

[22] Filed: Jun. 20, 1984

[30] Foreign Application Priority Data

Jun. 20, 1983 [JP] Japan ..... 58-109190
Jun. 20, 1983 [JP] Japan ..... 58-109386

[51] Int. Cl.[4] ..... B43L 11/04
[52] U.S. Cl. ..... 33/30.5
[58] Field of Search ..... 30/30 E, 30 R

[56] References Cited

U.S. PATENT DOCUMENTS 1,487,044 3/1924 Barach ..... 33/30 E
1,488,641 4/1924 Johnston ..... 33/30 E
2,654,952 10/1953 Solon ..... 33/30 E
3,947,968 4/1976 Rosenheck ..... 33/30 E

FOREIGN PATENT DOCUMENTS 167089 11/1950 Austria ..... 33/30 E
53-37771 10/1978 Japan .

*Primary Examiner*—William D. Martin, Jr.
*Attorney, Agent, or Firm*—Cushman, Darby & Cushman

[57] ABSTRACT

An arm extends out over the surface on which the ellipse is to be drawn, from a support in the form of a base plate with a handle that can be grasped to hold the support in a desired position. A piece of string is slackly fixed at two space sites along its length to two selected places spaced along the length of the arm of the support. A string-follower is provided in the form of a shaft having an arm radially and rotatably projecting from its lower end. At a site displaced from the shaft, a perforation is provided down through this arm. A drawing instrument is mounted to the string-follower so that its drawing tip underlies the lower opening of the perforation. The string extends down through the perforation to limit to limit the envelope of excursion of the string-follower in drawing an ellipse.

2 Claims, 10 Drawing Figures

Fig.3
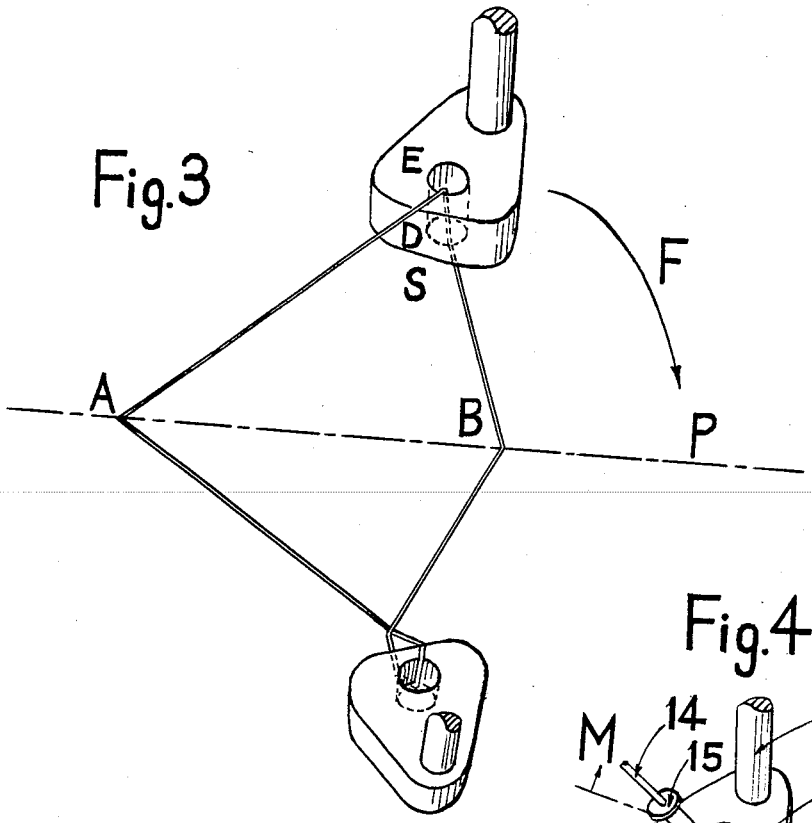
Fig.4
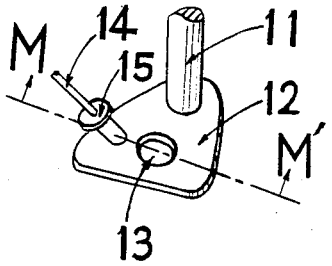
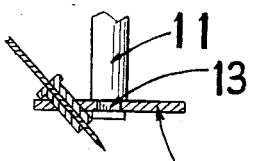
Fig.5

FIG. 6
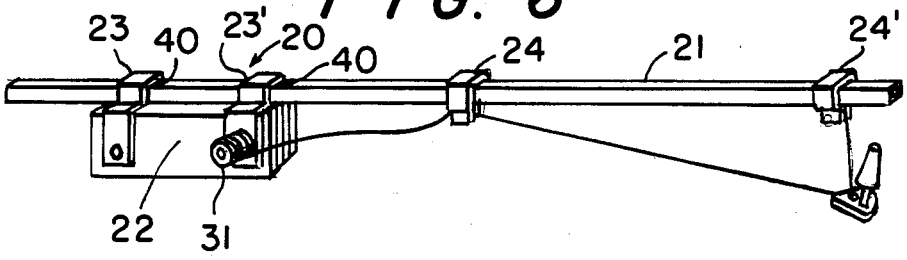
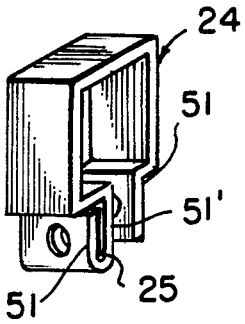
FIG. 7
FIG. 8
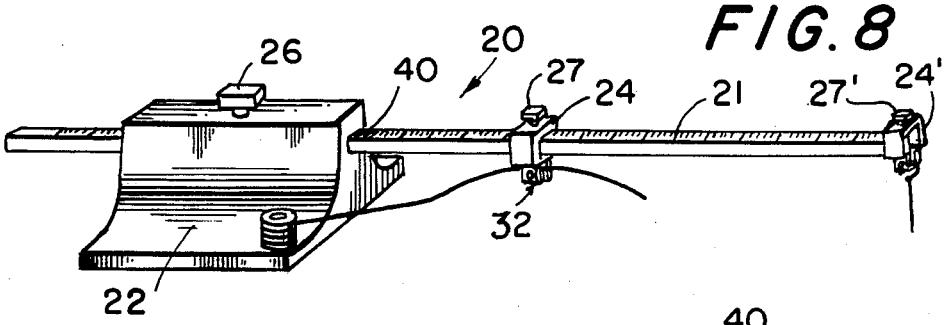
FIG. 9
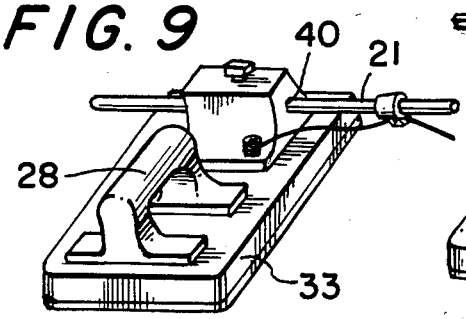
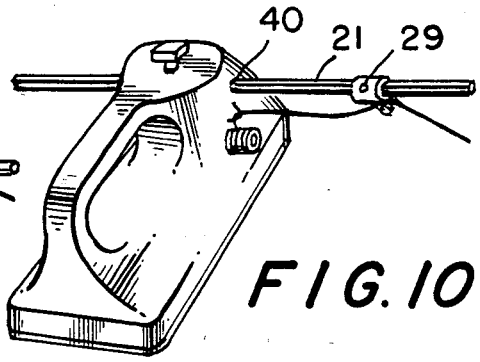
FIG. 10

APPARATUS FOR DRAWING AN ELLIPSE USING A PIECE OF STRING

FIELD OF THE INVENTION

The present invention relates to an apparatus for drawing an ellipse using a piece of string.

BACKGROUND OF THE INVENTION

It has been well known that as shown in FIG. 1, an ellipse can be drawn by placing the tip of a pencil inside a loop of string, the opposite ends of which are fixed at points A and B, respectively, with the distance between the points being shorter than the length of the string, and moving the pencil slidingly along the string while keeping the looped string tensioned by means of the pencil. When the pencil is moved across a line which passes through points A and B, the string is twisted as indicated by an arrow K. This twisting of the string prevents the drawing of an exact ellipse.

SUMMARY OF THE INVENTION

It is, therefore, a primary object of the present invention to provide a simple device, by which an ellipse can be drawn without causing the twisting of the string.

It is a secondary object of the present invention to provide a means for holding the opposite ends of the string, with which means the device can be more easily operated.

BRIEF DESCRIPTION OF THE DRAWINGS

FIG. 3 is a diagrammatic perspective view of the embodiment as shown in FIG. 1, except that the string passes through the perforation in a wrong manner so that the string is twisted.

FIG. 4 is a diagrammatic perspective view of an embodiment of the device according to the present invention showing the drawing instrument mounted to the arc thereof.

FIG. 5 is a diagrammatic sectional view of the embodiment as shown in FIG. 4 taken along a line M–M'.

FIG. 6 is a diagrammatic perspective view of an embodiment of a string-holding means according to the present invention.

FIG. 7 is a diagrammatic perspective view of an embodiment of a slider.

FIG. 8 is a diagrammatic perspective view of an embodiment of a string-holding means.

FIG. 9 is a diagrammatic perspective view of a part of an embodiment of a string-holding means, and FIG. 10 is a diagrammatic perspective view of a part of an embodiment of a string-holding means.

DETAILED DESCRIPTION OF THE INVENTION

Figure 1:
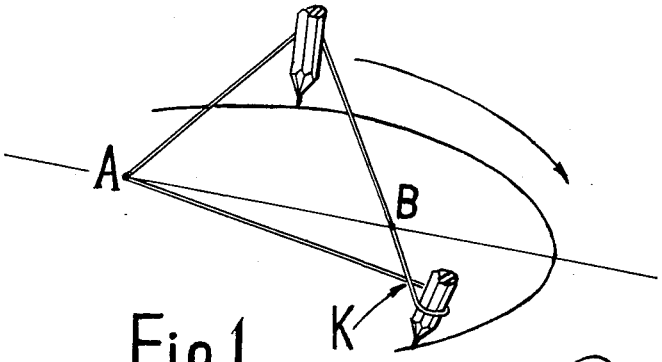
Fig.1 (PRIOR ART)
FIG. 1 is for showing the twisting of a string which occurs when an ellipse is drawn by using the string.
Figure 2:
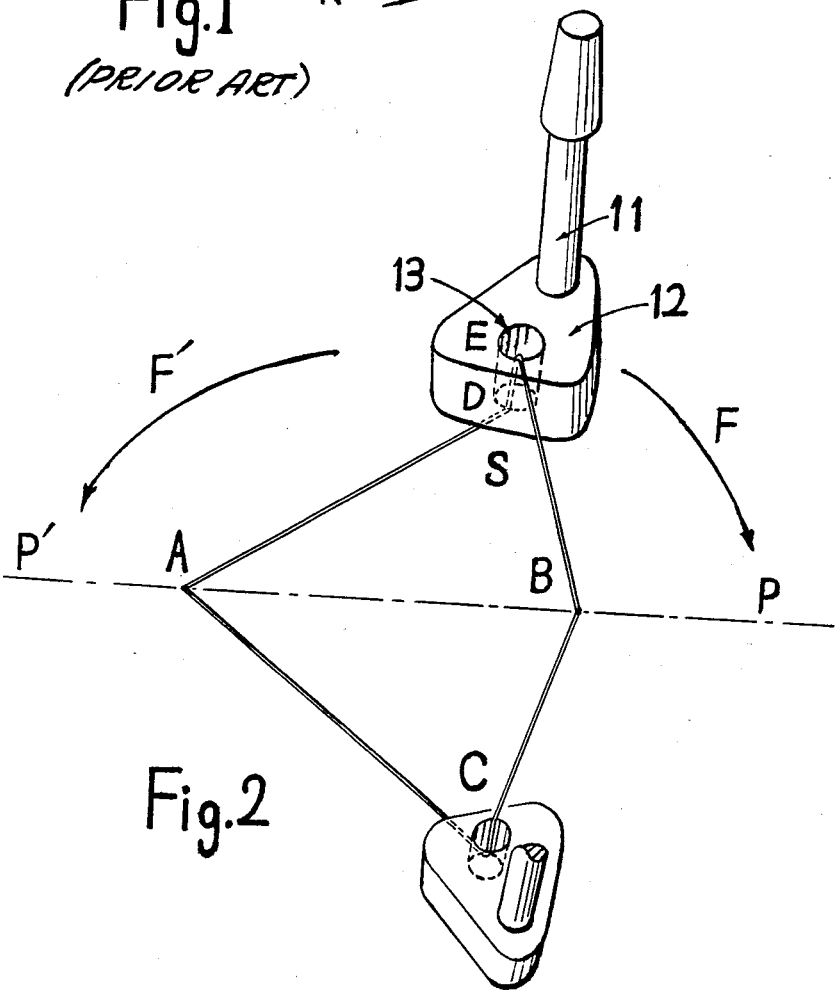
FIG. 2 is a diagrammatic perspective view of an embodiment of the device according to the present invention, showing the way of properly passing the string through a perforation contained in the arm of a guiding device.

Referring to FIG. 2, a device for drawing an ellipse according to the present invention comprises shaft (11) having arm (12) rotatably mounted on one end of the shaft. The arm contains perforation (13) which extends down through the arm (12) along a path that is generally parallel to the longitudinal axis of the shaft (11). A piece of string is passed from point A to point B through the perforation.

When an ellipse is drawn by moving the device in a direction of an arrow F across a line which passes through points A and B (the line is referred to as a line $\overline{AB}$ hereinunder), the string starting from point A and ending at point B must be passed through the perforation from the lower opening end D to the upper opening end E. If the string is passed through the perforation from the upper opening end E to the lower opening end D, the string is twisted after moving across the line $\overline{AB}$ as shown in FIG. 3.

When an ellipse is drawn by moving the device in a direction of an arrow F' across the line $\overline{AB}$, the string starting from point A and ending at point B must be passed through the perforation from the upper opening end E to the lower opening end D.

A writing means (14) such as a pencil, a piece of lead or chalk and the like is attached to arm (12) with the tip thereof being located just under the perforation as shown in FIG. 5. Where the drawing instrument (14) is rod-like with its drawing tip at its lower end, placing that tip under and in line with the lower opening of the perforation involves mounting the drawing instrument (14) to the arm (12) at a slant, e.g., as shown.

Preferably, the writing means should be held by an appropriate holder (15) fixed to arm (12) in a manner as the position of the tip can be controlled by shifting the means along the holder.

Referring to FIGS. 6 to 10, a means for holding the string at two locations corresponding to the abovementioned points A and B according to the present invention is generally indicated by (20). The string-holding means comprises an arm (21), a support (22) having at least one opening (40), into which the arm is inserted, two sliders (24, 24') and a winder (31). The arm may be made of a square rod, a square hollow cylinder, a round rod or a round hollow cylinder. The round rod or cylinder may have a channel or slit along a longitudinal axis thereof as shown in FIG. 10. The arm may have a scale on the surface thereof. Support (22) may have any configuration as long as it can support arm (21) horizontally. For example, the support may be a ring having a stem. Although the support as shown in FIGS. 6 and 8 can work as it is, it may be further fixed on a base plate (33) having a grip (28) mounted thereon as shown in FIG. 9. The support, the grip and the base plate may be formed in a unitary shape by a plastic moulding as shown in FIG. 10. Opening (40) may be formed as a perforation in the support or by using a rigid element having a channel (23, 23'). If necessary, screw (26) which can be screwed through a threaded opening running from the top surface of the support into the perforation may be used for fastening arm (21) to the support. Each of the sliders has a means for fixing it at a desired position on the arm and a means for fastening the string to the slider. As shown in FIG. 7, sliders (24, 24') may be a square or round open ring having tabs (51, 51'). Adjacent to one of the tabs, there is placed a piece (52) having an opening. The piece may be formed integrally with the tab. A bolt is inserted in the openings of the tabs and the piece and engaged with a nut. The string is sandwiched between the tab and the piece. By fastening the bolt and nut, the slider can be fixed at a desired position on the arm and simultaneously the string is fastened on the slider. If necessary, bolt (27, 27') which can be screwed into an threaded opening perforated in one side of the slider may be used for fixing the slider on the arm, and the combination of the tabs and the piece together with the bolt and nut may be used only for fastening the strings. When an excessively long string is used, an excess portion of the string may be held on a winder (31) mounted on the support. When arm (21) is made of a round rod having a channel along the axis thereof, the slider may have a pin (29) projected into the channel for preventing the slider from rotating around the arm, and also the supporter may have a protrusion (not shown) projected into the perforation for preventing the arm from rotating around its axis.

What is claimed is:

1. An apparatus for drawing an ellipse on a planar surface using a piece of string, comprising:

a string holder, including:

an arm;

a support having at least one opening into which a portion of said arm near one end of such arm may be inserted so that such arm is supported so as to extend over and parallel to said surface on which an ellipse is to be drawn; and two sliders slidably mounted on said arm; each of said sliders having:

means for fixing such slider in a selected position on such arm; and means for securing said string at a respective site on such string to the respective slider, so that the string, between such sites, is disposed to pass under said arm; and a string-guided drawing device, including:

a shaft which is adapted to be disposed generally upright in relation to said surface so as to have a relatively lower end nearer such surface and a relatively upper end further from said surface and arranged to be grasped for moving said drawing device;

an arm secured to said shaft so as to extend radially from said shaft in the vicinity of said lower end of said shaft, this arm being rotatable about the longitudinal axis of said shaft;

means defining a perforation through said arm of said device, this perforation extending generally parallel to the longitudinal axis of said shaft so as to have a relatively lower end opening nearer said surface and a relatively upper end opening further from said surface, this perforation being disposed at a site which is laterally displaced from where said arm of said device is secured to said shaft;

a drawing means adapted when moved across said surface with a tip thereof in engagement with said surface to draw a line on said surface; and securement means securing said drawing means to said arm of said device so that said tip of said drawing means is disposed relatively below said lower end opening of said perforation and aligned therewith along an axis that extends generally parallel to said longitudinal axis of said shaft, so that with a string slackly extending between and secured to said sliders of said string holder and said sliders fixed to said arm of said string holder, and with said string passing down through said perforation and thus slidably linking said drawing device with said string, said shaft may be moved with said tip of said drawing means in engagement with said surface in a sense to maintain the string taut while moving said tip about said surface, thus drawing an ellipse.

2. The apparatus of claim 1, wherein:

said support comprises a base plate having a handle adapted to be grasped for manually fixing said support at a selected position.

* * * * *